US007091422B1

(12) United States Patent
Stotz

(10) Patent No.: US 7,091,422 B1
(45) Date of Patent: Aug. 15, 2006

(54) FLEXIBLE FLAT CABLE WITH INSULATING LAYER HAVING DISTINCT ADHESIVES ON OPPOSING FACES

(75) Inventor: Darin D. Stotz, Lakeville, MN (US)

(73) Assignee: Multek Flexible Circuits, Inc., Northfield, MN (US)

( * ) Notice: Subject to any disclaimer, the term of this patent is extended or adjusted under 35 U.S.C. 154(b) by 0 days.

(21) Appl. No.: 11/046,558

(22) Filed: Jan. 28, 2005

(51) Int. Cl.
*H01B 7/08* (2006.01)

(52) U.S. Cl. ..... 174/117 F; 174/117 A

(58) Field of Classification Search ..... 174/117 F, 174/117 FF, 117 A
See application file for complete search history.

(56) References Cited

U.S. PATENT DOCUMENTS 6,132,236 A 10/2000 Kozel et al.
6,280,241 B1 8/2001 Herlinger et al.
6,377,220 B1 4/2002 Cook et al.
6,409,947 B1 6/2002 Wandyez
6,521,838 B1 2/2003 Yamanobe et al.

FOREIGN PATENT DOCUMENTS

WO WO 91/09406 * 6/1991

* cited by examiner

*Primary Examiner*—Chau N. Nguyen
(74) *Attorney, Agent, or Firm*—Dorsey & Whitney, LLP

(57) ABSTRACT

The present invention relates to a flexible flat cable and methods of making and using such a cable. In addition, the present invention relates to vehicle headliner including a flexible flat cable. In one embodiment, the cable includes a first insulating layer, a second insulating layer, a first adhesive, a plurality of conductors, a second adhesive, and a first liner.

4 Claims, 3 Drawing Sheets

FLEXIBLE FLAT CABLE WITH INSULATING LAYER HAVING DISTINCT ADHESIVES ON OPPOSING FACES

FIELD OF THE INVENTION

The present invention relates to a flexible flat cable ("FFC") including an array of conductors sandwiched between layers of a dielectric film. The present invention further relates to methods of manufacturing and methods of using the flexible flat cable.

BACKGROUND

Flexible flat cable is commonly used in electrical and electronic equipment such as business machines, industrial controls, telecommunication systems, and computers. It is also commonly used in vehicles (e.g., automobiles and aircraft) because of its low profile and its flexibility. A low profile cable can be easily placed underneath floor carpeting, between a door frame and a door panel, or between a headliner and a roof of a vehicle. A flexible cable can also be placed inside a flexing or oscillating component of a vehicle (e.g., a clockspring).

Conventional flat cable includes an array of round or flat conductors laminated between a dielectric film or insulating layer. Such flat cable assemblies commonly employ polyester (e.g., Mylar® films), polyvinyl, polyimide, polyetherimide, polyethylene naphthalate, or polycarbonate insulating films. These films are lightweight, flexible, and thin. The conductors are typically metallic conductors, such as flat copper. Etched conductors deposited on one substrate of the flat cable can also be employed. These conventional flat cables commonly employ an adhesive to bond the two insulating layers together and also the conductors located between the insulating layers.

Flexible flat cables are typically constructed by placing conductors between two insulating layers. The insulating layers are then bonded to each other and to the conductors by an adhesive. Commonly, heat-cured adhesives are used to create a strong and resilient bond. The adhesive is typically applied to the inner surface of the insulating layer, before placement of the conductors between the two layers. Once constructed, the flexible flat cable is later attached to the device or vehicle mechanically or using a later-applied adhesive.

As mentioned above, a common application of flexible flat cables is inside vehicle headliners. That is, the cable or cables are positioned between the headliner and the roof of the vehicle. These headliners are used in many types of vehicles including passenger cars, vans, buses, trucks, trains, and airplanes. Headliners are incorporated into vehicle roof constructions for a variety of reasons including aesthetics, sound absorption, energy absorption, and concealment of electrical wiring harnesses and air vents. Headliners typically include one or more flexible flat cables. The flat cables are attached to hidden upper surfaces of the headliner using fasteners that route the cables to a variety of electrical accessories mounted to the headliners. This process of routing and fastening the cables to the headliners is expensive and time consuming.

There is a need in the art for a flexible flat cable that may be quickly and easily attached to or integrated into various devices or to vehicle headliners. There is a further need for a method of manufacturing such a flexible flat cable.

BRIEF SUMMARY OF THE INVENTION

The present invention, in one embodiment, is flexible flat cable. The cable includes a first insulating layer, a second insulating layer, a first adhesive, a plurality of conductors, a second adhesive, and a first liner. The second insulating layer is disposed generally parallel to the first insulating layer. The first adhesive is disposed between the first and second insulating layers. The plurality of conductors is disposed between the first and second insulating layers. The second adhesive is disposed along an outer surface of the first insulating layer. Further, the first liner is removably attached to the second adhesive The present invention, in another embodiment, is a method of fabricating a moldable product incorporating a flexible flat cable. The method includes providing tape having first and second opposed surface, the first surface supporting a first adhesive and the second surface supporting a second adhesive. The method further includes arranging a plurality of conductors between two lengths of the tape, such that the first adhesives are opposed. In addition, the method includes forming the flexible flat cable by heating the tape to a first temperature above a first cure temperature of the first adhesive and below a second cure temperature of the second adhesive. Further, the method includes molding the moldable product, including the cable, by heating the moldable product and the cable to a second temperature above the second cure temperature.

In a further embodiment, the present invention is a method of attaching a flexible flat cable to a substrate. The method includes providing a flexible flat cable, removing the first liner, and applying the flexible flat cable to a substrate. The cable has a plurality of conductors, a first adhesive, a second adhesive, and a first liner. The plurality of conductors is disposed between a first and a second insulating layer. The first adhesive is disposed between the first and second insulating layers. The second adhesive is disposed along an outer surface of the first insulating layer. Further, the first liner is removably attached to the second adhesive.

In another embodiment, the present invention is a vehicle headliner. The headliner includes a headliner layer, a first insulating layer, a second insulating layer, and a plurality of conductors. The first insulating layer is attached to the headliner layer with an exterior adhesive. The second insulating layer is attached to the first insulating layer with an interior adhesive. Further, the plurality of conductors is disposed between the first and second insulating layers.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1A:
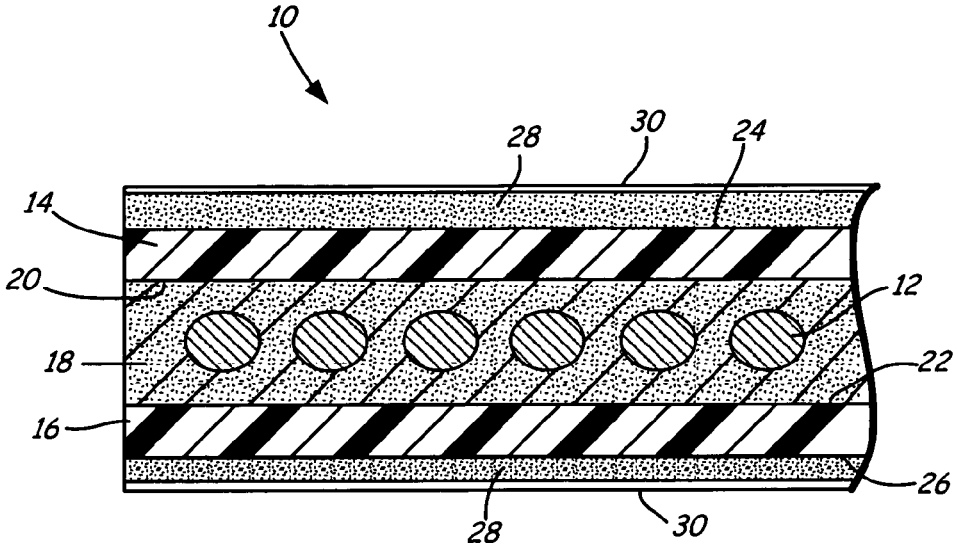
FIG. 1A is a section view of a flexible flat cable according to one embodiment of the present invention.

FIG. 1A is a sectional view showing a flexible flat cable 10 according to one embodiment of the present invention. As shown in FIG. 1A, the flexible flat cable 10 includes an array of conductors 12, an upper insulating layer 14, and a lower insulating layer 16. The conductors 12 are arranged between the insulating layers 14, 16 and are disposed spaced apart and generally parallel along a longitudinal length. As further shown in FIG. 1A, the insulating layers 14, 16 and the conductors 12 are bonded together using a first adhesive 18 located on inner surfaces 20, 22 of the insulating layers 14, 16. Outer surfaces 24, 26 of the insulating layers support a second adhesive 28. In the embodiment shown in FIG. 1A, the second adhesive 28 is covered with a release liner 30.

The conductors 12 may be made from any conductive material. In various embodiments, the conductors 12 are made from copper or copper alloys. In accordance with one aspect of the invention, the conductors 12 have a round or oval sectional shape. Alternatively, the conductors 12 may have any sectional shape including, for example, flat, square, or rectangular. The thickness or diameter of the conductors 12 varies depending on the size and current-carrying capacity needed for the cable 10.

The insulating layers 14, 16 may be any dielectric material capable of effectively insulating the conductors 12. The insulating layers 14, 16 typically have a dielectric constant of from about 2.4 to about 6.2, measured at 1 MHz. In one embodiment, the insulating layers 14, 16 are formed from a polymer. A variety of polymers can be used to form the thin film substrates including both vinyl and condensation polymers. In this embodiment, the insulating layers 14, 16 may be made from any of polyethylene, polypropylene, polystyrene, polyvinyl chloride, and polyacrylates. The insulating layers 14, 16 may also be made from polyester, polyimide, and polyetheretherketones. Polyimide materials are often used in applications requiring a significant heat history or range of heat parameters because of the heat stability of the polyimides. Some exemplary dialectrics that could be used in the insulating layers 14, 16 include, but are not limited to, polyethylene terephthalate polyester ("PET"), polyethylene naphthalate ("PEN"), polyimide ("PI"), polytetrafluoroethylene ("PTFE"), polyetherimide ("PEI"), polyethersulfone ("PES"), polysulfone ("PSO"), aramid (including commercial embodiments such as Nomex® and Kevlar®), liquid crystal polymer ("LCP"), polyetheretherketone ("PEEK"), polyvinyl fluoride ("PVF"), polyvinylidene fluoride ("PVDF"), Noryl®, polyvinyl chloride ("PVC"), and polyphenylene sulfide ("PPS").

The first adhesive 18 may be any adhesive known in the art for making flexible cables and flexible circuits, including any thermoplastic adhesive. In one embodiment, the first adhesive layer is from about 10 to about 75 microns thick. The first adhesive 18 may be an epoxy. In one embodiment, the first adhesive 18 is any thermoset adhesive, which sets under elevated temperature or pressure (or both). In one embodiment, the adhesive 18 has a cure temperature of about 100° C. or below. In another embodiment, the adhesive 18 has a cure temperature of from about 140° C. to about 200° C. Some exemplary adhesives that could be used as the first adhesive 18 include, but are not limited to, high flow rate modified epoxy adhesives, thermoplastic polyesters, polyester epoxy blends, butyral phenolics, nitrile phenolics, acrylic epoxy phenolics, polyurethanes, acrylics, or pressure sensitive adhesives ("PSA's").

The second adhesive 28 may also be any adhesive known in the art for making flexible cables and flexible circuits. The second adhesive 28, however, must have a higher cure temperature than the first adhesive 18, such that bonding of the insulating layers 14, 16 to the conductors 12 does not affect the second adhesive 28. In one embodiment, the second adhesive 28 is a thermoset adhesive having a cure temperature of from about 140° C. to about 220° C. The second adhesive 28 must also have a sufficient bonding strength to effectively secure the cable 10 to a device, vehicle, or any other substrate to which it is desirable to attach the cable 10 of the present invention. Some exemplary adhesives that could be used as the second adhesive 28 include, but are not limited to, restricted flow rate modified epoxy adhesives, PSA's, thermoplastic polyesters, acrylics, phenolics, epoxies, butyral phenolics, nitrile phenolics, acrylic epoxy phenolics, or polyurethanes.

Figure 1B:
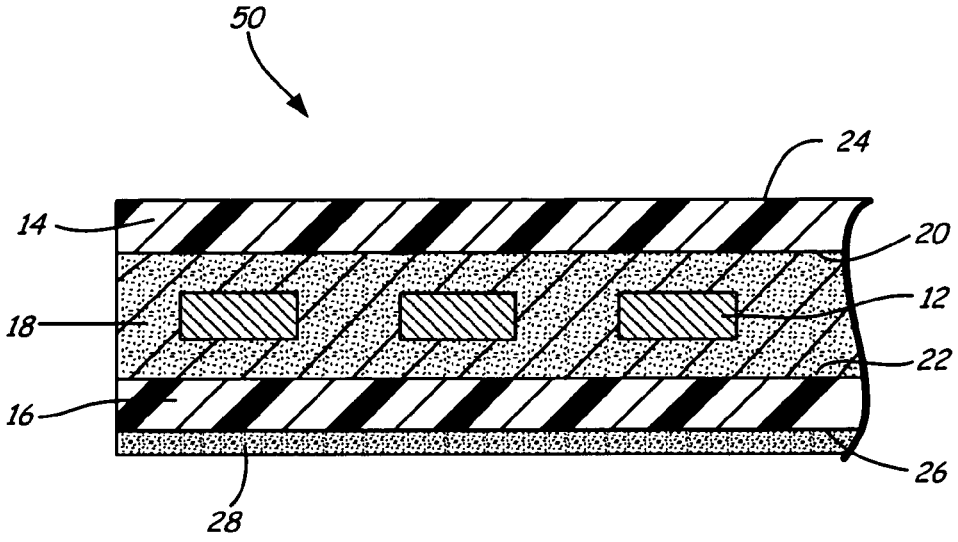
FIG. 1B is a section view of a flexible flat cable according to another embodiment of the present invention.

FIG. 1B is a sectional view showing a flexible flat cable 50 according to another embodiment of the present invention. As shown in FIG. 1B, the flexible flat cable 50 is a similar variation to the flexible flat cable 10. The flexible flat cable 50, however, includes conductors 12 that are generally rectangular in cross section. Also, in the cable 50, only one of the insulating layers 14, 16 supports a second adhesive 28.

Figure 2:
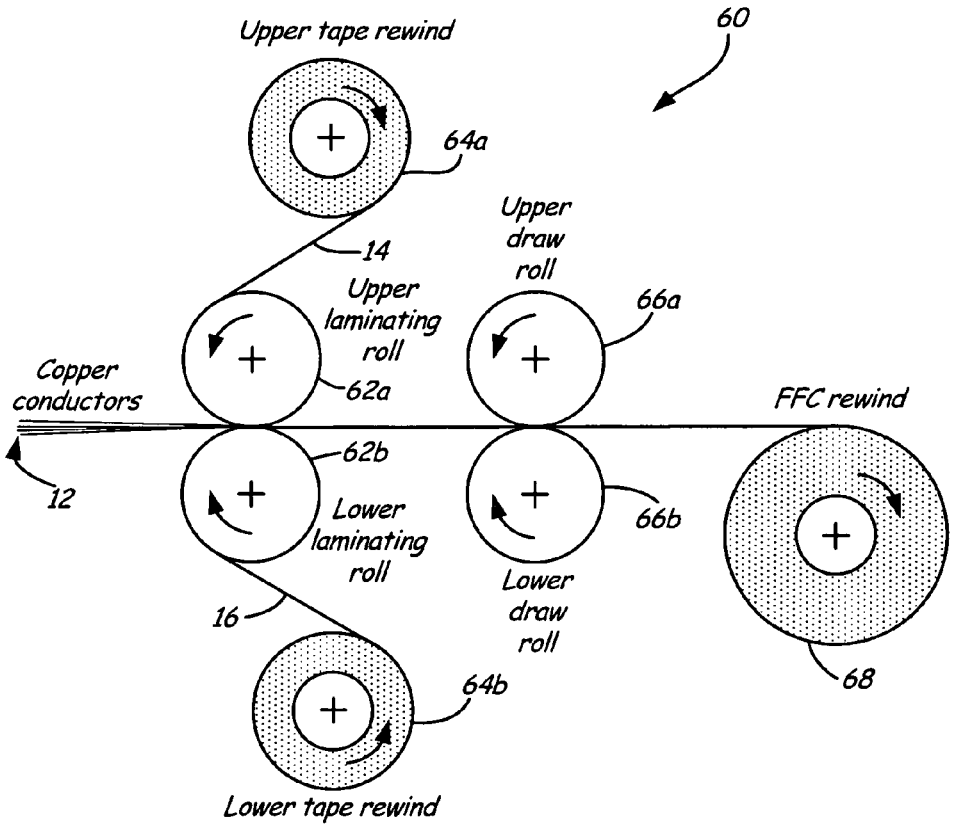
FIG. 2 is a schematic view of a cable construction system according to one embodiment of the present invention.

FIG. 2 is a schematic view showing a cable construction system 60 for constructing a flexible flat cable, in accordance with one aspect of the present invention. As shown in FIG. 2, the system 60 includes upper and lower laminating rolls 62*a*, 62*b*, which draw the conductors 12 and the insulating layers 14, 16. The insulating layers 14, 16, which include adhesive layers, are pulled from upper and lower tape rolls 64*a*, 64*b*, respectively. The cable is then compressed and heated by upper and lower draw rolls 66*a*, 66*b* to accomplish curing of the inner adhesive layer and bonding of the layers 14, 16 to each other and to the conductors 12. The completed flexible flat cable is then wound onto the rewind 68. The temperature and pressure applied by the upper and lower draw rolls 66*a*, 66*b* is controlled by the properties of the first adhesive 18 and the second adhesive 28, such that the first adhesive 18 is cured while the second adhesive 28 is unaffected. The flexible flat cable can then be unwound and applied to a device or vehicle using the second adhesive 28.

Figure 3:
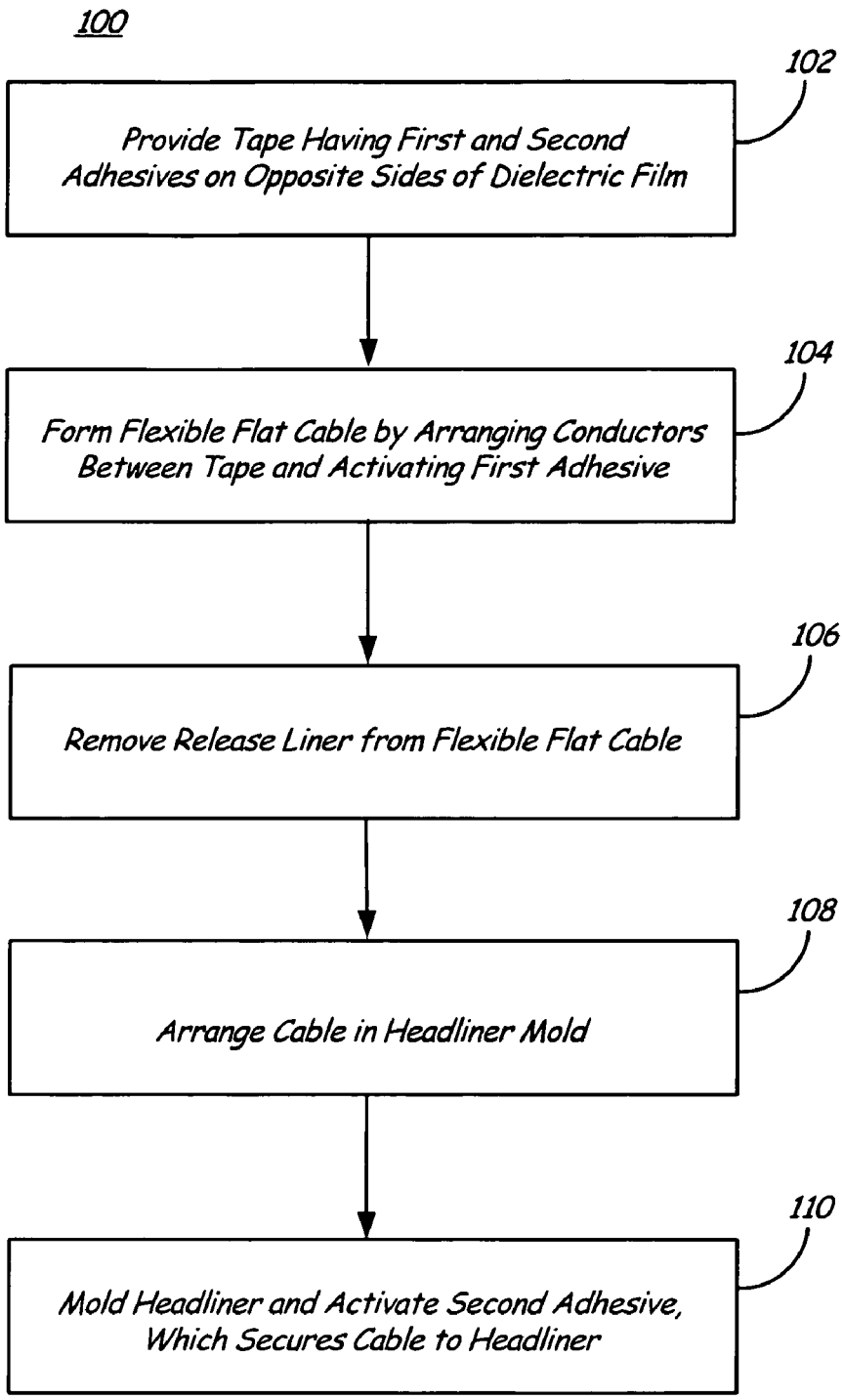
FIG. 3 is a flow chart depicting a moldable product fabrication method according to one embodiment of the present invention.

FIG. 3 is a flowchart showing a moldable product fabrication method 100 according to embodiment of the present invention. The method 100 for example, could be used to form a vehicle headliner. For purposes of the present application, "vehicle headliner" is intended to mean fabric covering the inside of the roof of a vehicle. Materials currently used in headliner construction include particleboard, fiberboard, plastic board, scrim, fabric, plastic, various foams, and resin-bonded chopped glass fiber. In some headliners, layers of these materials are joined together into a single laminate structure using lay-up-molding techniques. Some headliners are thermoformed laminates that include a polystyrene foam layer sandwiched between layers of paper or polymer film material and covered with soft polyurethane foam-backed fabric. Some constructions eliminate the paper or polymer film covering from such laminates and substitute a non-woven fabric adhered to one or both sides of the foam layer. Still other headliners, rather than being layered constructions, are simply molded from a single layer of a composition such as fiberglass reinforced polyester resin. The method 100 provides an efficient technique for combining placement of electrical cables with molding of the headliner. Alternatively, the technique can also be applied to any application combining placement of electrical cables with forming or molding of any material or product.

As shown in FIG. 3, the method 100 includes providing a tape having first and second adhesives (block 102) and forming a flexible flat cable by arranging conductors between two layers of tape and curing or setting the first inner adhesive layers (block 104). According to one embodiment, the conductors 12 are arranged between the two layers 14, 16 and the first adhesive layers are cured using the apparatus as shown in FIG. 2. Alternatively, the conductors are arranged between the two layers and the first inner adhesive layers are cured by any known method.

After curing the adhesive layers (block 104), the release liners are removed from the flexible flat cable (block 106). According to one embodiment, the release liners are removed to expose the second adhesive on the outer surface of the cable. Further, the cable is arranged in a headliner mold with the other components of the headliner (block 108). Alternatively, the cable is arranged with other components of any device or substrate to which the cable is being adhered. Further, the headliner is molded, which simultaneously cures the second adhesive (block 110). Alternatively, the device or substrate is molded and thus the second adhesive is cured.

In accordance with one aspect of the present invention, the two tapes used according to the method depicted in FIG. 3 have the same structure. Alternatively, the structures of the two tapes are different. For example, according to one embodiment, one tape 16 has both a first adhesive 18 on its inner surface 22 and a second adhesive 28 on its outer surface 26 while the other tape 14 has only a first adhesive 18 on its inner surface 20, but no adhesive on its outer surface 24, as shown in relation to the cable in FIG. 1B.

Although the present invention has been described with reference to preferred embodiments, persons skilled in the art will recognize that changes may be made in form and detail without departing from the spirit and scope of the invention.

The invention claimed is:

1. A flexible flat cable comprising:

(a) a first insulating layer;

(b) a second insulating layer disposed generally parallel to the first insulating layer;

(c) a first adhesive disposed between the first and second insulating layers;

(d) a plurality of conductors disposed between the first and second insulating layers;

(e) a second adhesive disposed along an outer surface of the first insulating layer, wherein the second adhesive has a higher cure temperature than the first adhesive; and (f) a first liner removably attached to the second adhesive.

2. The flexible flat cable of claim 1 further comprising:

(a) a third adhesive disposed along an outer surface of the second insulating layer; and (b) a second liner removably attached to the third adhesive.

3. A method of attaching a flexible flat cable to a substrate, comprising:

providing a flexible flat cable, the cable comprising:

a plurality of conductors disposed between a first and a second insulating layer;

a first adhesive disposed between the first and second insulating layers;

a second adhesive disposed along an outer surface of the first insulating layer, wherein the second adhesive has a higher cure temperature than the first adhesive; and a first liner removably attached to the second adhesive;

removing the first liner; and applying the flexible flat cable to a substrate.

4. Vehicle headliner comprising:

(a) a headliner layer;

(b) a first insulating layer attached to the headliner layer with an exterior adhesive;

(c) a second insulating layer attached to the first insulating layer with an interior adhesive, wherein the exterior adhesive has a higher cure temperature than the interior adhesive; and (d) a plurality of conductors disposed between the first and second insulating layers.

* * * * *